US008593247B2

(12) United States Patent
Jeong et al.

(10) Patent No.: US 8,593,247 B2
(45) Date of Patent: Nov. 26, 2013

(54) CHIP-TYPE COIL COMPONENT

(75) Inventors: Dong Jin Jeong, Gyunggi-do (KR); Jae Wook Lee, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/458,842

(22) Filed: Apr. 27, 2012

(65) Prior Publication Data

US 2012/0274435 A1 Nov. 1, 2012

(30) Foreign Application Priority Data

Apr. 29, 2011 (KR) ..... 10-2011-0040830

(51) Int. Cl.

| | |
|---|---|
| ***H01F 27/02*** | (2006.01) |
| ***H01F 21/04*** | (2006.01) |
| ***H01F 27/28*** | (2006.01) |
| ***H01F 27/30*** | (2006.01) |
| ***H01F 27/24*** | (2006.01) |

(52) U.S. Cl.

USPC ..... 336/200; 336/83; 336/115; 336/116; 336/195; 336/199; 336/205; 336/207; 336/208; 336/223; 336/232; 336/234

(58) Field of Classification Search

USPC ..... 336/200, 223, 232, 83, 115, 116, 199, 336/205, 207, 208, 221, 222

See application file for complete search history.

(56) References Cited

U.S. PATENT DOCUMENTS

| | | | | |
|---|---|---|---|---|
| 6,154,114 | A * | 11/2000 | Takahashi | 336/200 |
| 7,215,232 | B2 * | 5/2007 | Aoki et al. | 336/83 |
| 7,589,951 | B2 * | 9/2009 | Kunishi et al. | 361/306.3 |
| 7,623,014 | B2 * | 11/2009 | Hsieh et al. | 336/83 |
| 7,791,444 | B2 * | 9/2010 | Tomonari et al. | 336/192 |
| 8,305,729 | B2 * | 11/2012 | Ito et al. | 361/303 |
| 2003/0218526 | A1 * | 11/2003 | Fan | 336/83 |
| 2010/0109827 | A1 * | 5/2010 | Asou et al. | 336/192 |
| 2011/0133881 | A1 * | 6/2011 | Nakajima et al. | 336/200 |

FOREIGN PATENT DOCUMENTS

| | | |
|---|---|---|
| JP | 10-163004 A | 6/1998 |
| JP | 11-111556 | 4/1999 |
| JP | 11-288839 | 10/1999 |
| JP | 2000-196393 A | 7/2000 |

(Continued)

OTHER PUBLICATIONS

Office Action issued in Japanese Patent Application No. 2012-099531 dated Jul. 30, 2013.

(Continued)

*Primary Examiner* — Elvin G Enad
*Assistant Examiner* — Kazi Hossain
(74) *Attorney, Agent, or Firm* — McDermott Will & Emery LLP

(57) ABSTRACT

There is provided a chip-type coil component, including: a body formed by laminating a plurality of magnetic layers, and having a lower surface provided as a mounting area, an upper surface corresponding thereto, two end surfaces, and two lateral surfaces; conductor patterns formed on the magnetic layers, respectively, and connected to each other to have a coil structure; and external electrodes formed on at least one external surface of the body, and electrically connected to the conductor patterns, the external electrodes each being formed on the lower surface and spaced apart from edges thereof. Short circuits between electronic components may be prevented and sticking strength between the chip-type coil component and a substrate may be increased.

5 Claims, 2 Drawing Sheets

(56) References Cited

FOREIGN PATENT DOCUMENTS

| | | | |
|---|---|---|---|
| JP | 2002-217037 | A | 8/2002 |
| JP | 2003-272923 | A | 9/2003 |
| JP | 2004-031934 | A | 1/2004 |
| JP | 2006-332121 | A | 12/2006 |
| JP | 2007-088173 | A | 4/2007 |
| JP | 2008-198923 | A | 8/2008 |

OTHER PUBLICATIONS

Office Action with English translation issued on Apr. 30, 2012 in corresponding Korean Patent Application No. 10-2011-0040830.

* cited by examiner

CHIP-TYPE COIL COMPONENT

CROSS-REFERENCE TO RELATED APPLICATIONS

This application claims the priority of Korean Patent Application No. 10-2011-0040830 filed on Apr. 29, 2011, in the Korean Intellectual Property Office, the disclosure of which is incorporated herein by reference.

BACKGROUND OF THE INVENTION

1. Field of the Invention

The present invention relates to a chip-type coil component, and more particularly, to a chip-type coil component having excellent reliability.

2. Description of the Related Art

An inductor may be manufactured by winding a coil on a ferrite core or printing and forming electrodes at both ends thereof, or by printing a conductor pattern on magnetic sheets and laminating the thus obtained magnetic sheets having the conductor pattern. The latter is known as a laminated-type inductor.

Low-temperature co-fired ceramic (LTCC) technology may be used to laminate ceramic sheets for low-temperature firing, and the conductor patterns printed thereon may be simultaneously fired at a temperature of 800 to 900° C.

Recently, as electronic products have been miniaturized, slimmed and multifunctionalized, the chip inductor has also required to be miniaturized and fired at a low-temperature. As the degree of integration of electronic components is increased, the distance between mounted electronic components has gradually decreased, and in extreme cases, neighboring electronic components may contact each other.

Particularly, in the case in which external electrodes are formed on a mounting surface of an inductor and are protruded further than the edges of the inductor, when neighboring inductors are in contact with each other, the external electrodes also may be in contact with each other, resulting in short circuiting.

SUMMARY OF THE INVENTION

An aspect of the present invention provides a chip-type coil component having excellent reliability.

According to an aspect of the present invention, there is provided a chip-type coil component, including: a body formed by laminating a plurality of magnetic layers, and having a lower surface provided as a mounting area, an upper surface corresponding thereto, two end surfaces in a length direction thereof, and two lateral surfaces in a width direction thereof; conductor patterns formed on the magnetic layers, respectively, and connected to each other to have a coil structure; and external electrodes formed on at least one external surface of the body, and electrically connected to the conductor patterns, wherein the external electrodes each are formed on the lower surface and spaced apart from edges thereof.

The external electrode may include a plating layer formed thereon, and spacing distances between the edges of the lower surface and the external electrode may be larger than a thickness of the plating layer.

The number of external electrodes may be 2 or more.

The external electrodes may include first and second external electrodes opposingly formed on the lower surface.

The chip-type coil component may further include a third external electrode formed between the first and second external electrodes.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
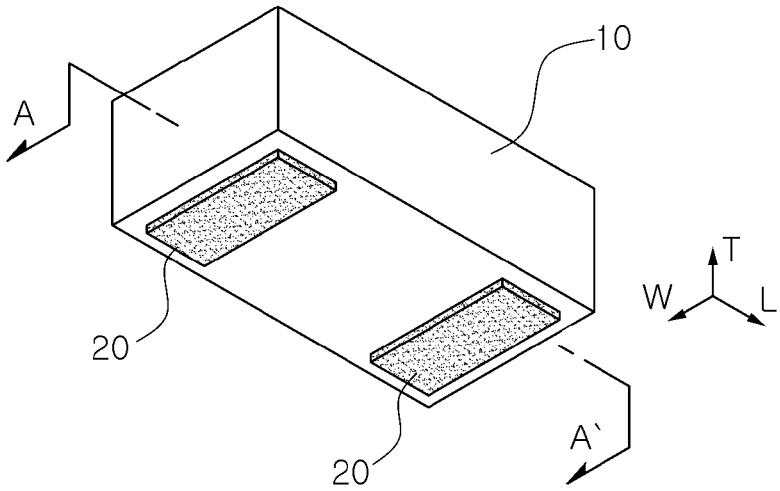
FIG. 1 is a perspective view of a chip-type coil component according to an embodiment of the present invention when seen from below.

Embodiments of the present invention will now be described in detail with reference to the accompanying drawings. However, the embodiments of the present invention may be modified to have many different forms and the scope of the invention should not be limited to the embodiments set forth herein.

The embodiments of the present invention are provided so that those skilled in the art may more completely understand the present invention. In the drawings, the shapes and dimensions may be exaggerated for clarity, and the same reference numerals will be used throughout to designate the same or like components.

Figure 2:
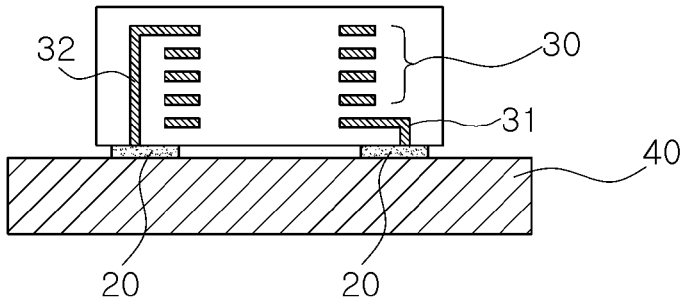
FIG. 2 is a cross-sectional view taken along line A-A' of FIG. 1.
Figure 3:
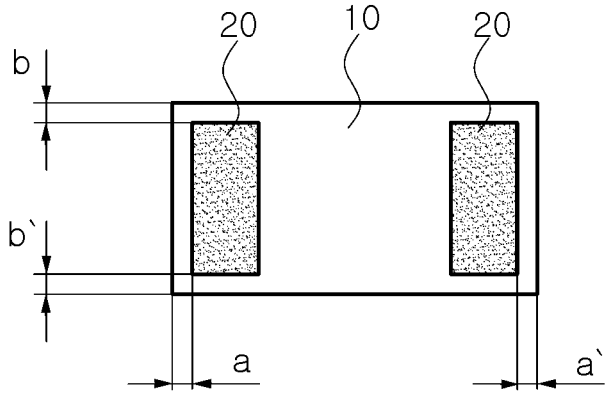
FIGS. 3 to 5 are lower plan views of chip-type coil components according to an embodiment of the present invention.
Figure 4:
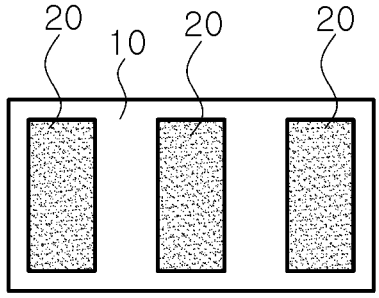
Figure 5:
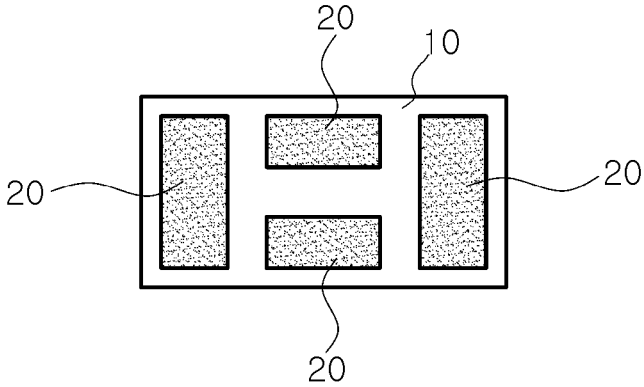

FIG. 1 is a perspective view of a chip-type coil component according to an embodiment of the present invention when seen from below; FIG. 2 is a cross-sectional view taken along line A-A' of FIG. 1; and FIGS. 3 to 5 are lower plan views of chip-type coil components according to an embodiment of the present invention.

Referring to FIG. 1, a length direction (L), a width direction (W), and a thickness direction (T) are defined in a chip-type coil component according to an embodiment of the present invention.

A chip-type coil component according to an embodiment of the present invention may include: a body 10 formed by laminating a plurality of magnetic layers and having a lower surface provided as a mounting area, an upper surface corresponding thereto, two end surfaces in a length direction thereof, and two lateral surfaces in a width direction thereof; conductor patterns 30 respectively formed on the plurality of magnetic layers and connected to each other to have a coil structure; and external electrodes 20 formed on at least one external surface of the body 10 and electrically connected to the conductor patterns 30. Here, the external electrodes 20 may be formed on the lower surface and spaced apart from edges thereof.

Together with a resistor and a capacitor, a coil component (inductor) maybe a main passive element constituting an electronic circuit, and may serve to remove noise or constitute an LC resonance circuit. The coil component (inductor) may be classified into several types, such as a laminated-type, a winding type, a thin film type, and the like, depending on the structure thereof. Among them, the laminated-type coil component has come into widespread use. The laminated type coil component is a coil component (inductor) formed by laminating a plurality of magnetic layers.

The body 10 may be formed by laminating the plurality of magnetic layers, and may have the lower surface provided as a mounting area, the upper surface corresponding thereto, two end surfaces in the length direction, and two lateral surfaces in the width direction.

The body 10 may be formed by laminating the plurality of magnetic layers.

The magnetic layer is referred to as a sheet formed by using a magnetic material. The magnetic layer may be formed by mixing a ceramic magnetic material powder, such as ferrite powder or the like, together with a binder and the like in a solvent, dispersing the magnetic material powder, such as ferrite powder or the like, in the solvent by ball milling or the like, and then preparing a thin magnetic sheet by a doctor blade method or the like.

The conductor patterns 30 may be formed on the magnetic layers, respectively, and may be connected to each other to have a coil structure.

The conductor patterns 30 may be formed on the magnetic layers, respectively, and electrically connected to the external electrodes 20 to constitute the coil structure.

The conductor pattern 30 may be formed by a method such as thick-filmprinting, coating, depositing, sputtering, or the like. The conductor pattern 30 may be formed on the magnetic layer by using a method such as screen printing or the like.

As an example of a conductive material used for forming the conductor pattern 30, a conductive paste contained in an organic solvent or the like may be generally used. As for the conductive paste, mainly, a nickel powder may be dispersed together with an organic binder and the like in the organic solvent.

The conductor patterns 30 may be electrically connected to each other by conductive vias. The conductive via may be formed by preparing a penetration hole in the magnetic layer and then filling the penetration hole with a conductive paste or the like. The conductive paste may contain a metal, such as Ag, Ag—Pd, Ni, Cu, or the like.

The conductor patterns 30 may be formed to have a coil structure within the body 10.

The coil structure of conductor patterns 30 formed on the magnetic layers may be sequentially connected to each other by the conductive vias respectively formed in the magnetic layers, and they may overlap in a lamination direction to constitute a spiral type coil structure.

Both ends of conductor patterns 30 having the coil structure may be drawn out to the outside of the body 20 by conductor leads 31 and 32, and connected to the external electrodes 20.

The conductor leads 31 and 32 maybe formed by via holes or through holes.

That is, the via or through holes may be formed in the magnetic layers, and filled with a conductive material to form vias, and then the magnetic layers may be laminated such that the vias are electrically connected to each other.

The coil structure of conductor patterns 30 may be electrically connected to the external electrodes 20 through the vias.

Referring to FIG. 3, the external electrodes 20 may be formed on the lower surface, and spaced apart form the edges of the lower surface.

The external electrodes 20 may be formed by a method such as printing a conductive paste, depositing or sputtering a conductive material, or the like. The conductive paste may contain a metal, such as Ag, Ag—Pd, Ni, Cu, or the like.

As electronic components become highly integrated, neighboring electronic components may contact each other. Here, in the case in which the external electrodes 20 are formed on the edge of the mounting surface or the external electrodes 20 are protruded to the outside of the mounting surface, a short circuit may occur between neighboring external electrodes 20.

In order to prevent this short circuit, the external electrodes 20 maybe spaced apart from the edges of the mounting surface inwardly at spacing distances a, a', b and b'.

As such, the external electrodes 20 are formed on one surface of the body 20, and thus, surface mounting may be easily performed. Further, an area occupied by the external electrodes 20 may be decreased, resulting in a high degree of electronic component integration.

A plating layer maybe formed on the external electrode 20 by copper or tin plating. The spacing distances a, a', b and b' between the edges of the lower surface and the external electrode 20 may be greater than a thickness of the plating layer.

A Ni plating layer and a Sn plating layer may be sequentially formed on a surface of the external electrode 20.

Normally, the external electrode 20 may be formed and then a plating layer may be formed on the external electrode 20. In this case, even in the case that the external electrode 20 is spaced apart from the edges of the mounting surface inwardly at spacing distances a, a', b and b', a short circuit may occur between neighboring electronic components when the spacing distances a, a', b and b' are smaller than the thickness of the plating layer.

The reason is that the external electrode 20 is protruded out of the edges of the mounting surface due to the plating layer formed on the external electrode 20.

Therefore, the spacing distances a, a', b and b' may be determined in consideration of the thickness of the plating layer formed on the surface of the external electrode 20.

The number of external electrodes 20 may be 2 or more, and may include first and second external electrodes opposingly formed on the lower surface.

The first and second external electrodes, that is, two external electrodes 20, may be formed on the mounting surface of the chip-type coil component.

The two external electrodes 20 may each have a rectangular shape, and may be opposingly formed on the mounting surface.

The external electrodes 20 may be mechanically and electrically connected to a substrate 40.

As an area of the external electrode 20 is wider, an adhering area between the chip-type coil component and the substrate 40 becomes widened, and as a result, the sticking strength between the chip-type coil component and the substrate 40 may be increased.

As the sticking strength between the chip-type coil component and the substrate 40 is increased, both elements may become strongly resistant to external shock, resulting in improved product reliability.

As shown in FIG. 4, the external electrodes 20 may further include a third external electrode formed between the first and second external electrodes.

The conductor patterns 30 may or may not be electrically connected to the third external electrode.

When the third external electrode is not electrically connected to the conductor patterns 30, it merely increases the sticking strength between the substrate 40 and the chip-type coil component.

Here, the first to third external electrodes are defined by merely determining the order thereof for convenience of explanation of the example and in order to divide positions of the external electrodes 20.

In the chip-type coil component according to embodiments of the present invention, the patterns of the external electrodes are not protruded out of the mounting surface, thereby preventing contact between external electrodes of electronic components, and thus, short circuits may be prevented.

Furthermore, sticking strength between the electronic component and the substrate may be increased by diversifying the pattern of the external electrode.

While the present invention has been shown and described in connection with the exemplary embodiments, it will be apparent to those skilled in the art that modifications and variations can be made without departing from the spirit and scope of the invention as defined by the appended claims.

What is claimed is:

1. A chip-type coil component, comprising:

a body formed by laminating a plurality of magnetic layers, and having a lower surface provided as a mounting area, an upper surface corresponding thereto, two end surfaces in a length direction thereof, and two lateral surfaces in a width direction thereof;

conductor patterns formed on the magnetic layers, respectively, and connected to each other to have a coil structure; and an external electrode formed on at least one external surface of the body, and electrically connected to the conductor patterns, the external electrode being formed on the lower surface and spaced apart from edges of the lower surface, wherein the external electrode includes a plating layer formed thereon, and spaced distances between the edges of the lower surface and the external electrode are larger than a thickness of the plating layer.

2. The chip-type coil component of claim 1, wherein the number of external electrodes is 2 or more.

3. The chip-type coil component of claim 2, wherein the external electrodes include first and second external electrodes opposingly formed on the lower surface.

4. The chip-type coil component of claim 3, further comprising a third external electrode formed between the first and second external electrodes.

5. The chip-type coil component of claim 1, wherein the conductor patterns are horizontal with the lower surface thereof.

* * * * *